US005984839A

United States Patent [19]

Corkum

[11] Patent Number: 5,984,839

[45] Date of Patent: Nov. 16, 1999

[54] EXERCISE MACHINE HAVING A BUILT-IN COMPUTER

[76] Inventor: Eric T. Corkum, 16 Gloria St., Newburyport, Mass. 09150

[21] Appl. No.: 09/072,576

[22] Filed: May 4, 1998

[51] Int. Cl.[6] ..... A63B 21/00

[52] U.S. Cl. ..... 482/54; 482/4; 482/902

[58] Field of Search ..... 482/1–9, 51–78, 482/901–903

[56] References Cited

U.S. PATENT DOCUMENTS 4,512,567 4/1985 Phillips ..... 482/902

5,314,391 5/1994 Potash et al. ..... 482/54

*Primary Examiner*—Glenn E. Richman

*Attorney, Agent, or Firm*—Frederick R. Cantor, Esq.

[57] ABSTRACT

A computer can be built into a pre-existing exercise machine so that the person using the machine can view the screen on the computer monitor while engaged in aerobic exercise activity. Keyboard mechanisms are secured to hand rails of the machine, whereby the person can operate the keyboards without releasing his grip on the hand rails. The computer monitor is adjustably supported to provide persons of different heights and head positionments a good view of the viewing screen on the monitor.

9 Claims, 3 Drawing Sheets

EXERCISE MACHINE HAVING A BUILT-IN COMPUTER

BACKGROUND OF THE PRESENT INVENTION

SUMMARY OF THE PRESENT INVENTION

This invention relates to an exercise machine and particularly to an exercise machine equipped with a built-in computer, whereby the person using the exercise machine can at the same time scan the computer monitor for information purposes or amusement purposes. By hooking the computer into the internet, the system will offer the person using the machine a vast amount of information.

Over the years, corporations have made substantial investments in fitness facilities for their employees. It has been shown that employee involvement in corporate fitness programs increases health, productivity and self-esteem, while at the same time reducing the health care costs of the corporation.

My invention is designed to increase the productivity of an employee while he is exercising his body on an exercise machine. The invention eliminates the problem of an employee failing to exercise because he has too much work to accomplish within the time available. With appropriate computer hook-ups, the employee will be able to access corporate voice, video and data networks within the corporate communication system, while at the same time enjoy the benefits of aerobic exercise on a stationary exercise machine. The invention can be applied to various types of exercise machines, e.g. treadmills, cycles and stepping machines, etc.

In addition to usage in the corporate environment, the invention can also be used in the commercial fitness (health) area and home fitness area. The individual using an exercise (fitness) machine will be able to surf the internet web, and enjoy an endless quantity of online news, information and entertainment features. The discomfort associated with exercise will be reduced, due to the fact that the individual can be engrossed in processing information of interest.

The nature of the invention will become more apparent from the attached drawings and description of an illustrative embodiment of the invention.

In summary, and in accordance with the above discussion, the foregoing objectives are achieved in the following embodiments.

1. In combination, an exercise machine having a front end and a rear end; a hollow post structure at the machine front end, an exercise function control panel atop said hollow post structure, and two hand rails at least partially supported by said post structure;

a television monitor supported by said post structure above said hand rails; and keyboard means for controlling the pictoral display on said monitor; said keyboard means comprising an array of thumb actuated switches supported by one of said hand rails, whereby the person using the exercise machine can operate said keyboard means while grasping said hand rails.

2. The combination, as described in paragraph 1, and further comprising an adjustable support means for said television monitor; said adjustable support means comprising a support arm extending from said post structure, and a television monitor platform having a hinged connection to said support arm.

3. The combination, as described in paragraph 1, wherein said television monitor has a viewing screen facing the occupant space above the exercise machine; and an adjustable support means for said television monitor; said adjustable support means comprising a support arm extending from said post structure, and a television platform having a hinged connection to said support arm; said hinged connection having a horizontal hinge axis that enables the television monitor to tilt around the hinged connection, whereby the viewing screen is readily viewable by different persons using the exercise machine.

4. The combination, as described in paragraph 1, wherein said keyboard means comprises an elongated switch panel angling downwardly from said one hand rail.

5. The combination, as described in paragraph 1, wherein said keyboard means comprises an elongated switch panel angling downwardly from said one hand rail, and means for varying the angulation of said switch panel relative to said one hand rail.

6. The combination, as described in paragraph 1, wherein said keyboard means comprises an elongated switch panel angling downwardly from said one hand rail; said switch panel comprising a printed circuit board, a flexible non-conductive cover sheet overlying said circuit board, and a series of electrical contacts spaced along said cover sheet for selective engagement with said printed circuit board in response to thumb pressure on said cover sheet.

7. The combination, as described in paragraph 1, wherein said exercise machine is a treadmill.

8. The combination, as described in paragraph 1, and further comprising a hollow support arm extending from said post structure in supporting relationship to said television monitor, and a microprocessor located in said hollow support arm.

9. The combination, as described in paragraph 8, and further comprising first lead wiring extending within said one hand rail for operatively connecting said keyboard means to said microprocessor, and second lead wiring linking said microprocessor to said television monitor.

DESCRIPTION OF A PREFERRED EMBODIMENT OF THE PRESENT INVENTION

FIGS. 1 through 4 show the invention applied to a treadmill type exercise machine. The invention can be applied to other types of exercise machines, e.g. cycles and stepping machines. The inventive concept involves building a computer into the machine, whereby the person using the machine can view and operate the computer monitor.

Figure 1:
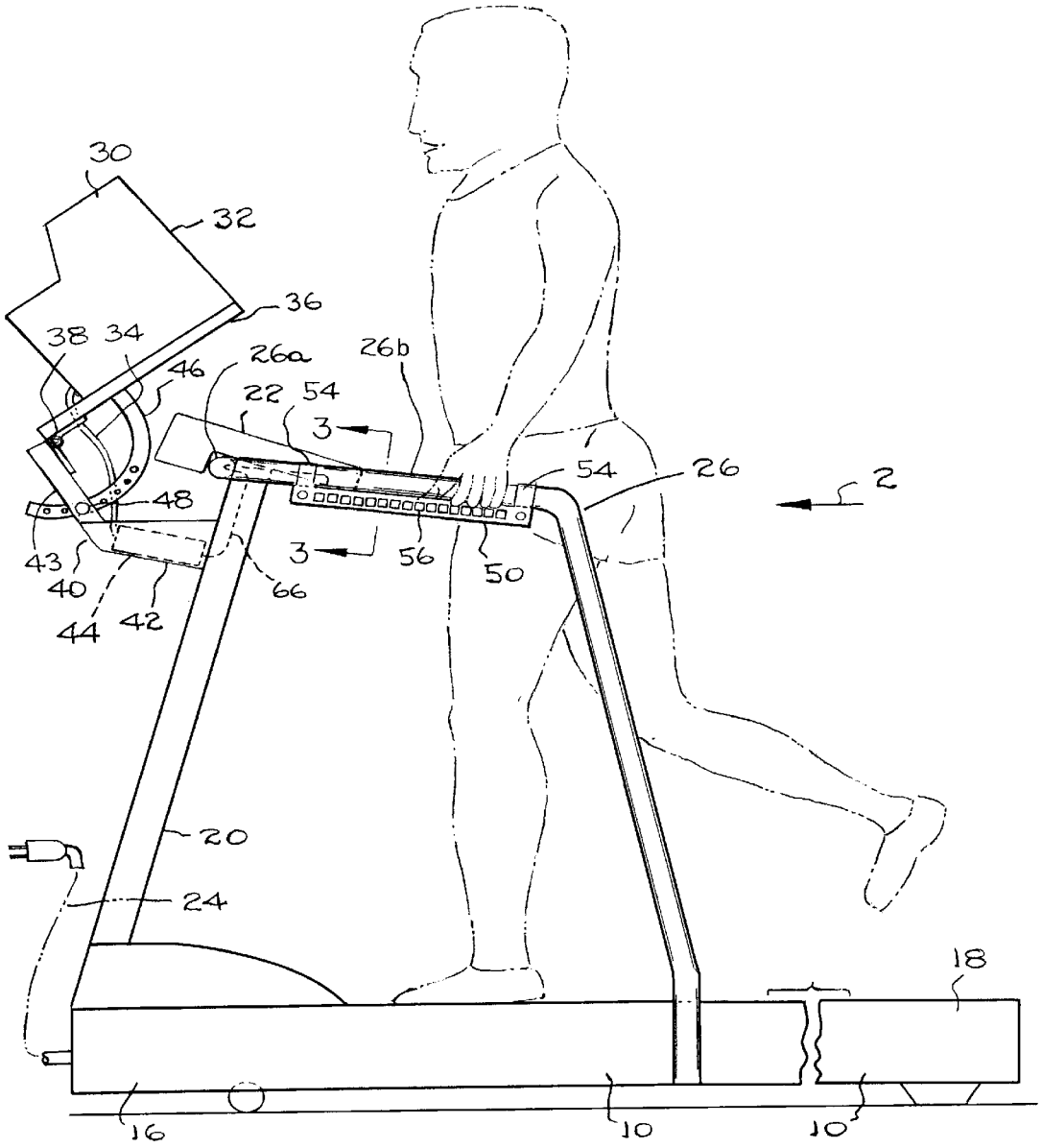
FIG. 1, is a side elevational view, of a computer-equipped exercise machine embodying the invention.

FIG. 1, is a side elevational view, of a computer-equipped exercise machine embodying the invention.

Figure 2:
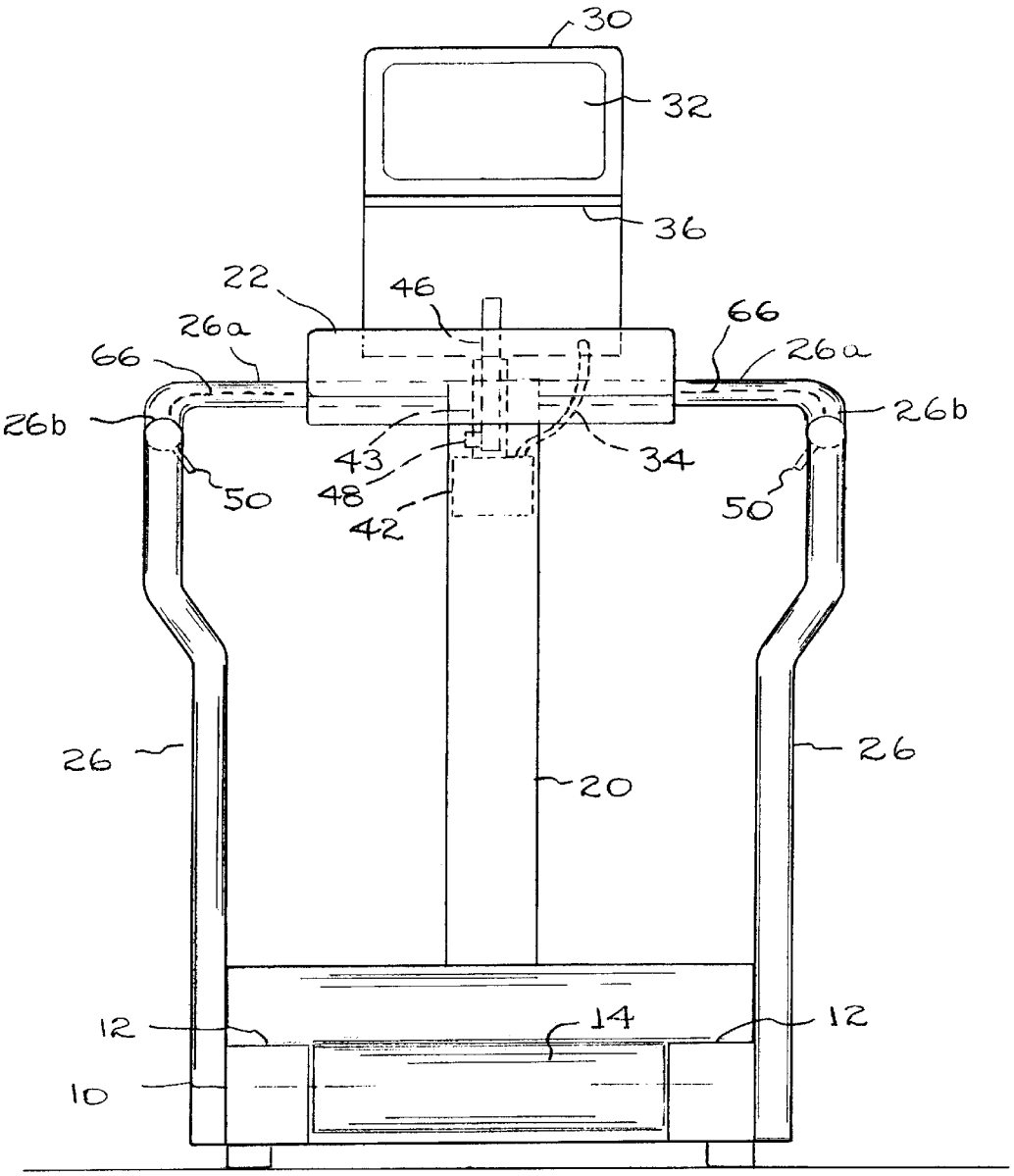
FIG. 2, is a right end view, of the FIG. 1 machine, taken in the direction of arrow 2 in FIG. 1.

FIG. 2, is a right end view, of the FIG. 1 machine, taken in the direction of arrow 2 in FIG. 1.

As shown in FIGS. 1 and 2, the exercise machine comprises a base 10 that includes two stationary side rails 12 and an endless motor-operated tread (or belt) 14 therebetween.

The machine has a front end 16 containing an electric motor for operating belt 14, and a rear end 18 containing an idler roller for the tread belt. At the machine front end there is an upstanding hollow post structure 20 that mounts an exercise function control panel 22. Panel 22 contains various controls and displays related to the exercise machine function, e.g. starting, stopping, belt speed, operating time, and distance travelled. Power for the machine is received from a household electric outlet, via electric cord 24. The electric motor in base 10 is connected to the electric componentry in panel 22 by means of lead wiring extending within hollow post structure 20.

The exercise machine is equipped with two hand rails 26 supported conjointly by base 10 and post structure 20. Each hand rail comprises a hollow tube having an outside diameter ranging from about one and one-half inch to above two inches. Each hollow tube includes a horizontal tube section 26*a* extending laterally from post structure 20, a slightly sloped hand grip section 26*b* extending right angularly from tube section 26*a*, and a vertical support section 26*c* extending downwardly from section 26*b* to a fixed connection with base 10.

In use of the exercise machine the person usually steps on the machine side rails 12 and then punches the appropriate key on panel 22 to start the motor that moves belt 14. When the belt is at a desired speed the person steps on the belt, and walks at the appropriate speed on the belt upper surface. While the person is walking on the belt 14 he grasps the side rail hand grip sections 26*b* to maintain his balance.

The present invention is concerned with an add-on computer built into the exercise machine. As shown in the drawing, the computer comprises a television monitor 30 having a viewing screen 32 and a power cord 34. The monitor is positioned on a platform 36 that has a hinge connection 38 with a support arm 40 th at extends from post structure 20. Support arm 40 comprises a hollow three dimensional section 42 attached to post structure 20 and a rectangular bar section 43 extending upwardly from section 42. Power cord 34 extends from the television monitor 30 into hollow section 42 for electrical connection with computer components 44 housed within hollow section 42. The computer components 44 will typically include a microprocessor, memory, and data transmission link to an external modem. The keyboard for operating the computer comprises separate keyboards mounted on hand rail sections 26*b*.

Hinge connection 38 enables the television monitor 30 to be tilted around the hinge axis, whereby screen 32 can be adjusted to different positions readily viewable by a range of different persons, i.e. persons having different heights and head positionments. Such adjustment of the monitor screen is considered desirable because of the near proximity of the person's head to the screen. Typically, the distance between the person's head and the screen 32 is only about twenty inches. The television monitor can be held in selected positions of adjustment by means of an arcuate brace 46 extending downwardly from platform 36 through a slot in rectangular bar 43. A set screw having a knob actuator 48 is threaded into bar 43 to engage depressions or holes in arcuate brace 46, whereby the brace is locked to bar 43 in selected positions of adjustment.

Figure 3:
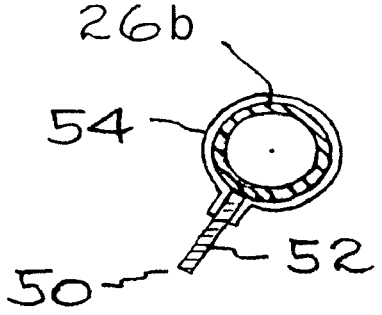
FIG. 3, is a detail sectional view, taken on line 3—3 in FIG. 1.

FIG. 3, is a detail sectional view, taken on line 3—3 in FIG. 1.

Many treadmill users need to grasp hand rail sections 26*a* while walking in order to maintain a proper balance. Therefore, the illustrated computer system includes two keyboards 50 located on hand rail section 26*a*, so that the person can operate the keyboards without removing his hands from gripper sections 26*a* of the hand rail.

Each keyboard 50 comprises a rectangular panel 52 angling downwardly from the associated hand rail section 26*a* as shown in FIG. 2. Each panel 52 can be attached to the tubular hand rail by strap type clamps 54 located at opposite ends of the panel. Each panel 52 can be angularly adjusted around the tube axis by loosening the clamps, repositioning the panel, and retightening the clamps.

Each panel 52 provides an array of manual (thumb actuated) switches or keys extending along the panel length. As depicted in FIG. 1, each switch is designated by an individual rectangle 56. The number of switches is determined by the panel length. As shown in FIG. 1, each panel 52 provides sixteen switches, or keys. Alternatively, this switch arrangement, if preferred, may be replaced by one, or more, standard keyboards.

Figure 4:
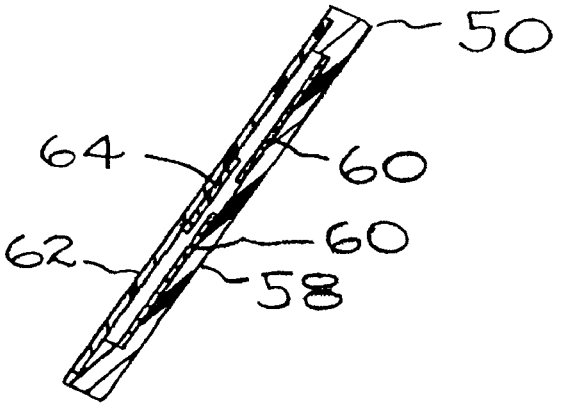
FIG. 4, is a sectional view, taken in the same direction as FIG. 3, but on an enlarged scale to show features not apparent from FIG. 3.

FIG. 4, is a sectional view, taken in the same direction as FIG. 3, but on an enlarged scale to show features not apparent from FIG. 3.

FIG. 4, shows a panel cross section that can be used. The panel has a rigid rear wall 58 having a printed circuit 60 thereon, and a flexible non-conductive cover sheet 62 overlying the printed circuit. A series of electrical contacts 64 are spaced along cover sheet 62 for selective engagement with different areas of the printed circuit. Each electrical contact 64 forms an individual switch or key. The configuration of the printed circuit determines the switch connections.

The person operates each keyboard by sliding his hand along the hand rail section 26*b* while maintaining his fingers in light gripping relation around the tubular hand rail. An individual key is operated by depressing the thumb against the selected area of the cover sheet 62 so as to complete an electrical circuit across the contact 64 in registry with the thumb. Panel 52 is relatively thin, such that the person's hand can slide along the rail surface without losing a grip on the hand rail; the person's fingers can curl around the hand rail in an essentially normal gripping fashion.

Keyboard 50 can be electrically connected to the componentry 44 in arm 40 by means of lead wiring 66 extending within the tubular hand rail 26 and post structure 20. The computer is built into the exercise machine without substantially changing the exercise machine. This makes it possible to incorporate the computer into the exercise machine as an add-on option to a pre-existing exercise machine.

Structural modifications of the machine to incorporate the computer involve drilling holes in hand rail section 26*b* and post 20 to accommodate lead wiring 66, and making electrical connections to the existing wiring to provide power for the computer. Arm 40 can be bolted to the post structure 20 to provide the necessary support for the computer monitor.

The drawings necessarily show a specific form of the invention. However, it will be appreciated that the invention can be practiced in various forms, as required to incorporate the computer into various types of exercise machines.

The present invention, described above, relates to an exercise machine having a built-in computer. Features of the present invention are recited in the appended claims. The drawings contained herein necessarily depict structural features and embodiments of the exercise machine having a built-in computer, useful in the practice of the present invention.

However, it will be appreciated by those skilled in the arts pertaining thereto, that the present invention can be practiced in various alternate forms, proportions, and configurations. Further, the previous detailed description of the preferred embodiment of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. In combination, an exercise machine having a front end and a rear end; a hollow post structure at the machine front end, an exercise function control panel atop said hollow post structure, and two hand rails at least partially supported by said post structure;

a television monitor supported by said post structure above said hand rails; and keyboard means for controlling the pictoral display on said monitor; said keyboard means comprising an array of thumb actuated switches supported by one of said hand rails, whereby the person using the exercise machine can operate said keyboard means while grasping said hand rails.

2. The combination, as described in claim 1, and further comprising an adjustable support means for said television monitor; said adjustable support means comprising a support arm extending from said post structure, and a television monitor platform having a hinged connection to said support arm.

3. The combination, as described in claim 1, wherein said television monitor has a viewing screen facing the occupant space above the exercise machine; and an adjustable support means for said television monitor; said adjustable support means comprising a support arm extending from said post structure, and a television platform having a hinged connection to said support arm; said hinged connection having a horizontal hinge axis that enables the television monitor to tilt around the hinged connection, whereby the viewing screen is readily viewable by different persons using the exercise machine.

4. The combination, as described in claim 1, wherein said keyboard means comprises an elongated switch panel angling downwardly from said one hand rail.

5. The combination, as described in claim 1, wherein said keyboard means comprises an elongated switch panel angling downwardly from said one hand rail, and means for varying the angulation of said switch panel relative to said one hand rail.

6. The combination, as described in claim 1, wherein said keyboard means comprises an elongated switch panel angling downwardly from said one hand rail; said switch panel comprising a printed circuit board, a flexible non-conductive cover sheet overlying said circuit board, and a series of electrical contacts spaced along said cover sheet for selective engagement with said printed circuit board in response to thumb pressure on said cover sheet.

7. The combination, as described in claim 1, wherein said exercise machine is a treadmill.

8. The combination, as described in claim 1, and further comprising a hollow support arm extending from said post structure in supporting relationship to said television monitor, and a microprocessor located in said hollow support arm.

9. The combination, as described in claim 8, and further comprising first lead wiring extending within said one hand rail for operatively connecting said keyboard means to said microprocessor, and second lead wiring linking said microprocessor to said television monitor.

* * * * *